United States Patent [19]

Rhodes

[11] Patent Number: 4,833,833

[45] Date of Patent: May 30, 1989

[54] SANDING APPARATUS FOR WORKING A PERIPHERAL EDGE OF A WORKPIECE

[76] Inventor: William J. Rhodes, P.O. Box 16348, Louisville, Ky. 40216

[21] Appl. No.: 49,426

[22] Filed: May 14, 1987

[51] Int. Cl.[4] ..... B24B 5/00

[52] U.S. Cl. ..... 51/144; 51/141; 51/145 R

[58] Field of Search ..... 51/144, 145 R, 141, 51/147, 145 T, 101 R, 283 E

[56] References Cited

U.S. PATENT DOCUMENTS

| | | | |
|---|---|---|---|
| 4,091,573 | 5/1978 | Schmidt | 51/145 R |
| 4,203,261 | 5/1980 | Davies | 51/145 R |
| 4,292,767 | 10/1981 | Fatula | 51/145 R |

*Primary Examiner*—Frederick R. Schmidt
*Assistant Examiner*—Maurina Rachuba
*Attorney, Agent, or Firm*—Charles G. Lamb

[57] ABSTRACT

A sander for finish working the peripheral edge of a workpiece includes a power driven workpiece carrying member which is moved in a horizontal plane and supports the workpiece so that the workpiece moves with the workpiece carrying member. The workpiece carrying member moves with rotational and translation motion in a horizontal plane. An endless sanding belt is located adjacent to the workpiece carrying member with one belt flight located adjacent the workpiece carrying member and, thus, the peripheral edge of the workpiece. A workpiece edge contouring head is located to the back side of the sanding belt at a location along the belt flight which is adjacent the peripheral edge of the workpiece and is biased to force the sanding belt against the peripheral edge of the workpiece. The sanding belt and contouring head are mounted for conjoint pivotal movement about a common pivot.

6 Claims, 2 Drawing Sheets

SANDING APPARATUS FOR WORKING A PERIPHERAL EDGE OF A WORKPIECE

BACKGROUND OF THE INVENTION

Field of the Invention

The present invention relates to sanding devices and more particularly to an improved sander for finish working the peripheral edge of a workpiece.

Various apparatus for sanding workpieces are known to the art.

U.S. Pat. No. 2,123,269 teaches a sanding machine or apparatus for shaping the sides and backs of shoes. The apparatus includes a turret table upon which the shoes are located and an endless sanding belt located adjacent to the turret table. The belt is engaged immediately behind the working region at the periphery of the turret table by a stiff brush. The stiff brush is mounted in a head supported in a bracket pivoted at and forced against the run of belt by a spring to maintain a constant resilient pressure on the belt.

U.S. Pat. No. 2,192,240 teaches a sanding machine for sanding a preselected shape into a piece of stock. The stock to be sanded is clamped to a rotary table. Two pivoting arms are pivotally mounted to a base. Belt sanders are attached at the free ends of the pivoting arms and the arms pivot to move the belt sanders toward and away from the stock as the table rotates to shape the edge of the stock.

U.S. Pat. No. 2,312,028 teaches a sanding apparatus having a turret with carrier units pivotally mounted thereon. A workpiece is mounted in the carrier units. A sanding belt is forced against the workpiece by a contoured form block.

U.S. Pat. No. 2,352,690 teaches a sanding apparatus having a turret wheel upon which workpiece holding heads are mounted. Sanding belts are located next to the turret wheel. A contoured forming block is positioned behind the sanding belts to force the sanding belt against the workpiece.

U.S. Pat. No. 3,049,839 teaches a sanding machine for sanding flat wood panels having sanding belts located to the opposite sides of the panels. A platen is located behind the sanding belts to force the belts against the panel. The platens are mounted to a pivotal frame.

U.S. Pat. No. 4,031,668 teaches a sanding apparatus for contouring a workpiece located at a workstation. A sanding belt is located over the workpiece. A backup member presses the sanding belt against the workpiece. The backup member is an inflatable air bag. The air bag is attached to the apparatus frame by rods and springs so that the inclination of the air bag backup member relative to the workpiece can be changed.

U.S. Pat. No. 4,037,366 teaches a profile sanding machine which includes a turn table for holding the workpiece. Two sanding belts are located opposite each other across the turn table. Each of the sanding belts are trained about a roller and an air inflatable roller. The air inflatable roller is located next to the turn table. When the turn table is rotated, the belt is moved toward the turn table so that the inflatable roller presses the sanding belt against the edge of the workpiece on the turn table.

U.S. Pat. No. 4,084,356 teaches a sanding apparatus for contouring the surface of a panel. The apparatus includes an endless sanding belt which is forced against the surface of a panel by a frame which supports an air bag.

U.S. Pat. No. 4,203,261 teaches a belt sanding apparatus for sanding a cylindrical workpiece held in a lathe. The apparatus includes an endless sanding belt next to the workpiece and is pressed against the workpiece by a contact plate. The contact plate has a contoured face which is in contact with the sanding belt to form the portion of the sanding belt in contact with the workpiece into a desired shape.

U.S. Pat. No. 4,292,767 teaches a sanding apparatus for sanding the edge of a non-circular workpiece. The workpiece is mounted for rotation about a central axis. The sanding belt is trained about three rollers. The roller is located adjacent the workpiece and is mounted to a movable slide for movement toward and away from the workpiece as the workpiece revolves or rotates about its axis.

SUMMARY OF THE INVENTION

The present invention provides a sanding device for finish working the peripheral edge of a workpiece comprising a power driven workpiece carrying member capable of rotational, or translational movement, or a combination of both motions, in a plane; a fixture mounted for pivotal movement in the plane of, or a plane parallel to the plane of movement of the workpiece carrying member; an endless sanding belt mounted on the fixture for movement therewith, and having at least one belt flight located adjacent the workpiece carrying member and peripheral edge of the workpiece carried thereon; and, a workpiece edge contouring head mounted on the fixture for movement therewith and located to the backside of the at least one belt flight for contacting the belt flight and forcing the belt flight toward the workpiece carrying member and into contact with the peripheral edge of the workpiece carried thereon.

BRIEF DESCRIPTION OF THE DRAWINGS

The present invention will become even more clear upon reference to the following description in conjunction with the accompanying drawings in which like numerals refer to like parts throughout and wherein.

DETAILED DESCRIPTION OF THE PREFERRED EMBODIMENT

Figure 2:
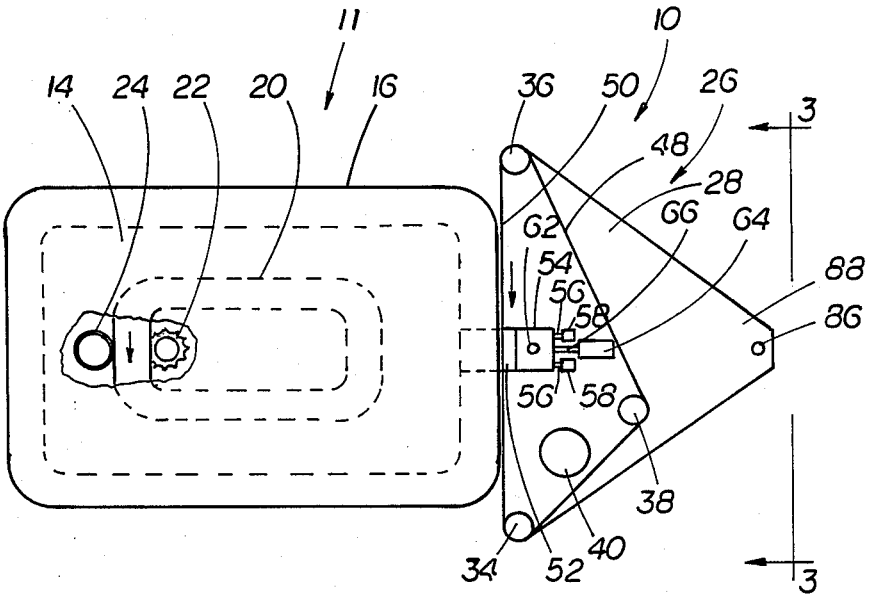
FIG. 2 is a top view of the sanding device as seen in the direction of arrows 2—2 in FIG. 1.
Figure 1:
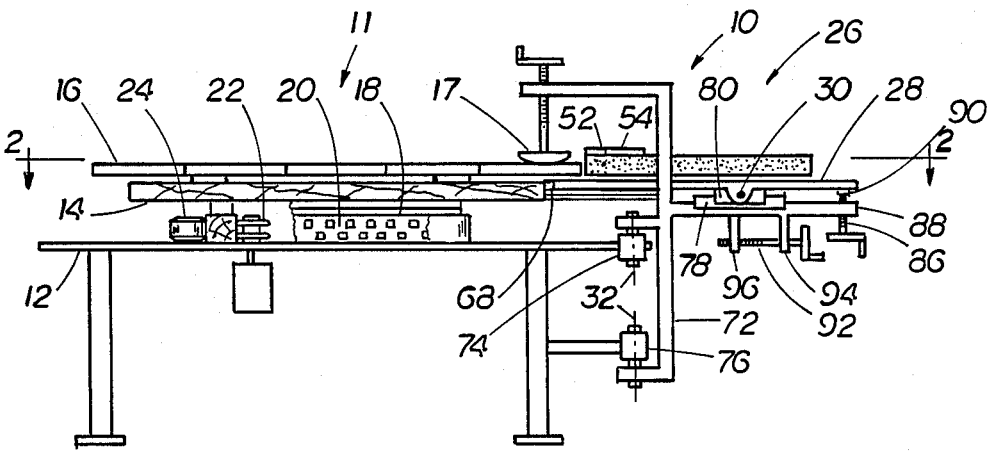
FIG. 1 is a diagramatic side view of one preferred sanding device of the present invention.

FIGS. 1 and 2 show a sanding device 10 which includes a power driven workpiece carrying member 11 with a table 12 having a smooth top surface, and a template 14 positioned on the table top surface for complete freedom of movement thereon. A workpiece 16 is supported on, and moves with the template 14. The workpiece 16 is clamped against the template 14 by a hold-down member 17. The hold-down member 17 can be virtually any conventional or otherwise convenient design. The peripheral configuration of the template 14 corresponds to the peripheral configuration of the finished workpiece 16.

The template 14 is supported on a pallet 18 which has a closed track 20 affixed to and projecting downwardly from the underside of the pallet 18. The track 20 rests on the top surface of the table 12 and slides on the table top surface. The pallet 18 is free to move on the table top surface by rotation, translation, or both. The closed track 20 is engaged by drive means comprising pressure rollers 22 and 24 which engage the track 20 on opposite sides thereof. The pallet 16 and, therefore template 14, make a complete cycle (360°) corresponding to one round trip of the closed track 20 past pressure rollers 22 and 24. The drive means is further adapted for movement laterally of the table top.

Apparatus of the type discussed above are well known to the art, and for the sake of brevity and clearness of understanding of the present invention it will not be further discussed. For a more thorough understanding of the workpiece carrying member 11 of the sanding device 10, reference is made to the workpiece carrying positions of the shaping devices described in U.S. Pat. Nos. 3,447,420 issued on June 3, 1969, and 4,036,269 issued on July 9, 1977.

Figure 3:
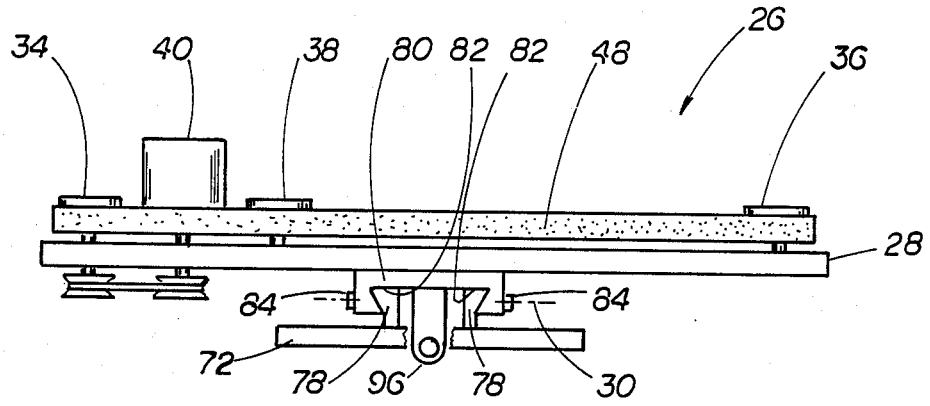
FIG. 3 is an enlarged end view of a portion of the sanding device as seen in the direction of arrows 3—3 in FIG. 2; and, FIG. 4 is an enlarged plan view of a component of the sanding device of FIGS. 1 and 2.
Figure 4:
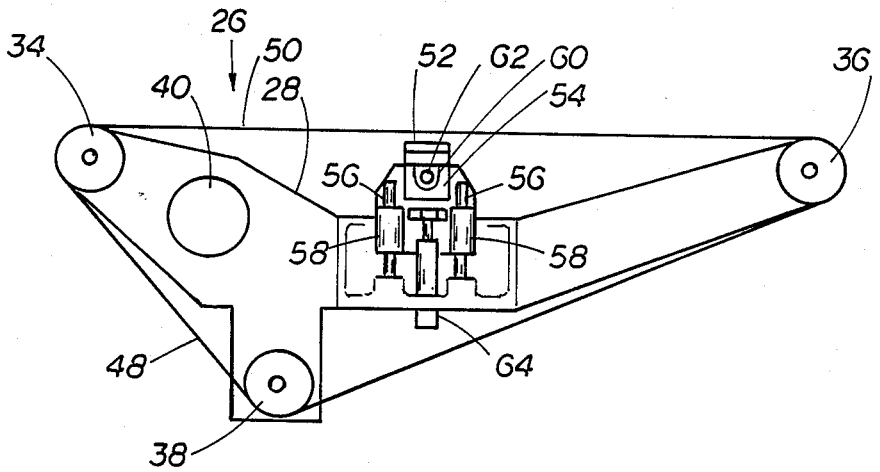

With continued reference to FIGS. 1 and 2, and additional reference to FIG. 3, the present invention provides a sanding belt apparatus, generally denoted as the numeral 26, positioned laterally of the table top and adjacent the peripheral edge of the template 14 for finishing the contour of the peripheral edge of the workpiece 16. The sanding belt apparatus 26 includes a fixture 28 which is affixed to the table 12 for selected pivotal movement about a horizontal axis 30 such that the fixture 28 will move through an arc in a plane perpendicular to the table top surface, and pivotal movement about a vertical axis 32 such that the fixture will move through an arc in a plane parallel to and over the table top surface. Three sanding belt pulleys 34, 36, 38 are rotatably mounted to the frame 28 with their axes of rotation virtually parallel, and parallel to the vertical axis 32 of pivotal movement of the fixture 28. A motor 40 is mounted to the fixture 28 for driving one of the belt pulleys 34. The motor 40 is drivingly connected to the pulley 34 by a drive belt 42 trained about a sheave 44 attached to the output shaft of the motor 40 and a sheave 46 attached to the pulley 34. An endless sanding belt 48 is trained about the three sanding belt pulleys 34, 36, 38 such that one of the sanding belt flights 50 is adjacent to the peripheral edge of the template 14 and, therefore, adjacent the peripheral edge of the workpiece 16 such that the front working surface of the belt flight 50 will contact the peripheral edge of the workpiece 16 to be sanded. A workpiece edge contouring head 52 is located at the back side of the belt flight 50 between the sanding belt pulleys 34 and 36 and is adapted to contact with the back side of the belt flight 50 to force the front working surface of the belt against the peripheral edge of the workpiece 16. The face of the workpiece edge contouring head 52 has a contour conforming to the contour to be formed in the peripheral edge of the workpiece 16. The workpiece edge contouring head 52 is mounted on a head block 54 which is movably attached to the fixture 28. A pair of parallel spaced apart guide rods 56 are attached to the fixture 28 and extend in a cantileveral fashion in a horizontal plane perpendicular to the belt flight 50. The mounting block 54 includes two spaced apart bushings 58 which receive the guide rods 56 so that the mounting block 54 can move on the guide rods 56 in a direction perpendicular to the sanding belt flight 50 toward and away from the belt flight 50. The mounting block 54 further includes a contour head mounting bracket 60 which is adjustably movable in a vertical direction perpendicular to and across the back side of the belt flight 50. The mounting block 54 has a vertical shaft 62 which is received in a hole 64 in the bracket 60 so that the bracket is movable in a vertical direction on the shaft 62. Thus, the position of the contouring head 52 transversely across the width of the belt flight 50 can be adjusted by moving the bracket 60 on the shaft 62. A pneumatic or hydraulic cylinder device 64 is attached to the fixture 28 and has its operating rod 66 parallel to and located between the guide rods 56 and attached to the mounting block 54. Thus, as the cylinder device 64 is operated to extend the operating rod 66, the mounting block 54 is moved toward the sanding belt flight 50 forcing the contouring head 52 against the sanding belt flight, and forcing the sanding belt flight 50 against the peripheral edge of the workpiece 16. As the cylinder device 64 is operated to retract the operating rod 66, the mounting block 54 is moved away from the sanding belt flight 50, thus moving the contouring head 52 away from the sanding belt flight 50 relieving the force of the workpiece contouring head 52 against the sanding belt flight 50.

A rub strip 68 is positioned on the fixture 28 below and parallel to the sanding belt flight 50 proximate to and perpendicular to the pivot axis 32 of the fixture 28. The rub strip 68 is adapted to contact the peripheral edge of the template 14 as the template 14 moves in the plane of the table top and follows the contour of the peripheral edge of the template 14. Thus, as the template 14 moves with the pallet 18 over the table top, the fixture 28 is caused to pivot about the pivot axis 32 due to the constant force exerted by cylinder device 64 so that the sanding belt flight 50 and contouring head 52 follow the curves of the template 15 and therefore the corresponding curves to be sanded on the workpiece 16.

As mentioned above, the fixture 28 is mounted for pivotal movement about a horizontal axis 30 and for pivotal movement about a vertical axis 32. In addition, the fixture 28 is also mounted for movement over the table top surface toward and away from the peripheral edge of the template to provide for adjustment of the fixture 28 position and head 52 position relative to different sized templates 14 and, therefore, different sized workpieces. Toward this objective, the fixture 28 is mounted to a frame 72, and the frame 72 is pivotally mounted to the table 12 by journal mounts 74, 76 defining the vertical axis 32. This fixture 28, thusly, moves with the frame 72 about the vertical axis 32. The frame 72 also includes a pair of parallel spaced apart fixture guide rails 78 centered on and extending parallel to the block guide rods 56. The fixture 28 includes a guide plate 80 having guide channels 82 which receive the fixture guide rails 78 so that the fixture 28 will move along the guide rails 78. The fixture 28 is pivotally mounted to the guide plate 80 by journal mounts 84 defining the horizontal axis 30.

The selected pivotal movement of the fixture 28 about the horizontal axis 30 provides for the selected orientation of the sanding belt flight 50 and contouring head 52 relative to the peripheral edge of the workpiece 16 which allows for sanding at an incline to the peripheral edge of the workpiece 16. As shown, the fixture 28 can be selectively tilted about the horizontal pivot axis 30 by means of, for example, a jack screw 86. The jack screw 86 is threaded through an appropriately threaded bore in a jack screw support bracket 88 which is connected to the fixture guide plate 80. The extending end of the jack screw 86 is attached to the fixture 28 by a pivot 90 so that the fixture 28 can move about the horizontal pivot axis 30 and pivot 90 as the jack screw 86 is operated.

As shown, the fixture 28 is mounted for selected movement in the direction of the guide rails 78 toward and away from the peripheral edge of the template 14 by a jack screw 92 threaded through appropriately threaded bores in a pair of jack screw support brackets 94 and 96. The bracket 94 is affixed to and depends from frame 72 between the fixture guide rails 78 and the bracket 96 is affixed to the underside of the fixture guide plate 80 and depends therefrom also between the fixture guide rails 78. As the jack screw 92 is operated, the fixture guide plate 80 and, therefore, the fixture 28 is caused to move along the guide rails 78.

The foregoing detailed description is given primarily for clearness of understanding and no unnecessary limitations are to be understood therefrom for modifications will become obvious to those skilled in the art upon reading this disclosure and may be made with department from the spirit of the invention and scope of the appended claims.

What is claimed:

1. A sander for finish working the peripheral edge of a workpiece comprising:

a power driven workpiece carrying member for carrying the workpiece thereon having rotational and translational movement in the plane of the rotational movement, and a combination of both motions, in the same plane;

fixture means mounted for pivotal motion about a first axis perpendicular to the plane of movement of the workpiece carrying member such that the fixture means has a movement in an arc having a plane parallel to the plane of movement of the workpiece carrying member;

means for mounting the fixture means for selected pivotal movement at a second axis perpendicular to the first axis such that the fixture means has a movement in an arc having a plane perpendicular to the plane of movement of the workpiece carrying member;

means for mounting the fixture means for selected pivotal movement at a second axis perpendicular to the first axis such that the fixture means has a movement in an arc having a plane perpendicular to the plane of movement of the workpiece carrying member;

means for mounting the fixture means for selected linear movement at a constant and continuous force toward the workpiece and for moving the fixture means away from the workpiece carrying member independently of the pivotal movement of the fixture means;

sanding belt means mounted on the fixture means for movement therewith about the first pivot axis, about the second pivot axis, and linearly toward and away from the workpiece carrying member, the sanding belt means being located on the fixture means adjacent the workpiece carrying member and peripheral edge of the workpiece carried thereon; and, a workpiece edge contouring head mounted on the fixture means for movement therewith about the first pivot axis, about the second pivot axis, and linearly toward and away from the workpiece carrying member, and the workpiece edge contouring head also being mounted on the fixture means for linear movement independently of the movement of the fixture means toward and away from the workpiece carrying member and sanding belt means for forcing the sanding belt means toward the workpiece carrying member and into contact with the peripheral edge of the workpiece carried thereon whereby the workpiece edge contouring head and sanding belt means are held in contact with the peripheral edge of the workpiece at a constant and continuous force as the workpiece is sanded.

2. The sander of claim 1, wherein the sanding belt means comprises:

an endless sanding belt having one belt flight located adjacent the workpiece carrying member and peripheral edge of the workpiece; and, the workpiece edge contouring head is located to the backside of the sanding belt flight for forcing the sanding belt flight toward the workpiece carrying member and into contact with the workpiece carried thereon.

3. The sander of claim 2, wherein the workpiece edge contouring head is mounted to the fixture for selected movement transversly across the width of the sanding belt flight.

4. The sander of claim 2, wherein the workpiece carrying member moves in a direction opposite to the direction of movement of the sanding belt flight at the location whereat the sanding belt flight is adjacent the workpiece carrying member.

5. The sander of claim 2, wherein the at least one sanding belt flight is in the plane of movement of the workpiece carrying member.

6. The sander of claim 1, wherein:

the workpiece carrying member comprises a template having a peripheral edge conforming to the peripheral shape of the workpiece; and, the fixture means comprises means for engaging with the peripheral edge of the template for pivotally moving the fixture in plane of or plane parallel to the plane of movement of the workpiece carrying member in response to the pattern defined by the peripheral edge of the template.

* * * * *